United States Patent [19]

Fleming

[11] Patent Number: 4,536,980

[45] Date of Patent: Aug. 27, 1985

[54] PIN SCREEN

[76] Inventor: Ward Fleming, 88 W. Broadway, New York, N.Y. 10007

[21] Appl. No.: 527,741

[22] Filed: Aug. 30, 1983

Related U.S. Application Data

[60] Continuation-in-part of Ser. No. 423,114, Sep. 24, 1982, abandoned, which is a division of Ser. No. 91,125, Mar. 21, 1980, Pat. No. Des. 270,317.

[51] Int. Cl.[3] ..... A47F 11/06

[52] U.S. Cl. ..... 40/427; 40/579; 446/118

[58] Field of Search ..... 40/579, 447, 427; 46/16; 248/316.1; 433/72, 75; 33/174 D

[56] References Cited

U.S. PATENT DOCUMENTS

| | | | |
|---|---|---|---|
| 3,400,478 | 9/1968 | O'Keefe | 40/447 |
| 3,568,357 | 3/1971 | Lebensfeld | 40/579 |
| 3,586,248 | 6/1971 | Riebold | 248/316.1 |

FOREIGN PATENT DOCUMENTS

| | | | |
|---|---|---|---|
| 2357621 | 5/1975 | Fed. Rep. of Germany | 40/579 |
| 907977 | 3/1946 | France | 33/512 |
| 2267736 | 11/1975 | France | 33/512 |
| 119002 | 9/1980 | Japan | 33/515 |
| 2037471 | 7/1980 | United Kingdom | 40/579 |

OTHER PUBLICATIONS

"American Journal of Orthodontics", vol. 76, No. 1, p. 53, Jul. 1979.

*Primary Examiner*—Gene Mancene
*Assistant Examiner*—Cary E. Stone
*Attorney, Agent, or Firm*—Parmelee, Bollinger & Bramblett

[57] ABSTRACT

A pin screen includes a plate having a plurality of closely spaced small apertures. The plate is supported in a substantially horizontally fixed position, and each of the apertures defined therein are adapted to receive a pin in a substantially vertical orientation. The heads of the pins are larger than the diameters of the apertures to assure that the pins do not fall through the apertures. The pins are vertically movable relative to the horizontal plate between a lower position in which the bottom of the pin heads abut against the upper surface of the plate, and an upper position in which the top of the pin heads abut against the lower surface of a transparent sheet of material spaced at a predetermined distance above the apertured plate. The pins may also be moved such that the pin heads are intermediate the lower apertured plate and the upper transparent sheet. Light rays impinging upon the pin heads positioned at varying attitudes relative to the apertured plate, or upon the moving pin heads, provide the appearance of visually animated action and dynamically changing displays.

The pin screen may also be vertically housed so that the pins are horizontally oriented and held in position by frictional engagement with at least one vertical apertured plate. In the vertical embodiments of the pin screen, a contoured three-dimensional image is created by the selective horizontal displacement of pins relative to the vertical apertured plate, and the displaced pins remain in their image-creating position until intentionally displaced to a different position.

10 Claims, 9 Drawing Figures

PIN SCREEN

BACKGROUND OF THE INVENTION

The present application is a continuation in part of U.S. Ser. No. 423,114 filed on Sept. 24, 1982 now abandoned, which itself is a divisional application of U.S. Design patent application Ser. No 091,125 filed Mar. 21, 1980 now U.S. Pat. No. D270,317.

The invention described herein and in the applications referred to above is designated as a pin screen. The pin screen is a multi-purpose table or platform supported entertainment device. It functions as an artistic animation image producer or display by creating visual patterns resulting from the displacement of a plurality of pins relative to a supporting apertured plate. The pin screen is aesthetically appealing and also provides enjoyable participatory entertainment for both children and adults.

SUMMARY OF THE INVENTION

The pin screen provided by the present invention includes an apertured plate supported in a substantially horizontal fixed position by a supporting table, platform or the like. The plate includes a plurality of closely spaced openings defined therein, each of the openings being adapted to movably receiving a pin therethrough. A transparent sheet formed from for example, glass or plastic can be spaced a predetermined distance above the apertured plate in parallel relationship thereto. The heads of the pins that are inserted through the apertured plate are larger than the diameters of the apertures to prevent the pins from falling therethrough. The pins are vertically movably relative to the apertured plate by applying force to the shank portions of the pins extending from beneath the apertured plate. Accordingly, the pins can be moved between a first position in which the bottom of the pin heads abut against the upper surface of the apertured plate, and a second position in which the tops of the pin heads abut against the lower surface of the upper transparent sheet. The pins may also selectively be moved so that the pin heads are intermediate the lower apertured plate and the upper transparent sheet. Dynamic visual displays and dynamically changing patterns may be created by the vertical displacement of all or some of the pins relative to the apertured plate.

In other embodiments, the pin screen is provided with a vertical housing which includes at least one vertically oriented apertured plate for receiving and holding a plurality of horizontally oriented pins. By selectively displacing the horizontal pins, as for example, by pressing against the ends of the pins extending from the apertured plate, a three-dimensional configuration or image of the impression is created by the horizontally displaced pins. The pins are held in a horizontally displaced position by frictional engagement with the apertured plate.

DESCRIPTION OF THE PREFERRED EMBODIMENT

The preferred embodiment of a pin screen in accordance with the present invention is illustrated by FIGS. 1-9 of the drawings.

Figure 1:
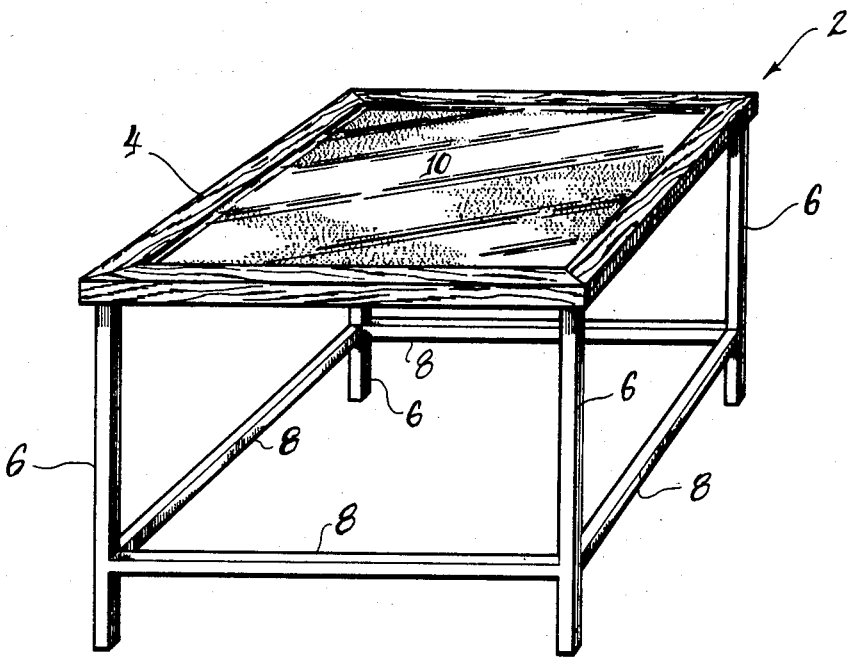
FIG. 1 is a perspective view of a pin screen illustrating the preferred embodiment of the invention.

FIG. 1 illustrates a perspective view of the pin screen. A table or platform 2 includes a generally square top frame 4. The top frame 4 is supported by a plurality of downwardly extending legs 6, which in turn, are supported by a plurality of horizontal braces 8. A top transparent cover 10, preferably formed from glass or plastic, is removably mounted within the top frame 4 as shown in FIGS. 1 and 4.

Figure 2:
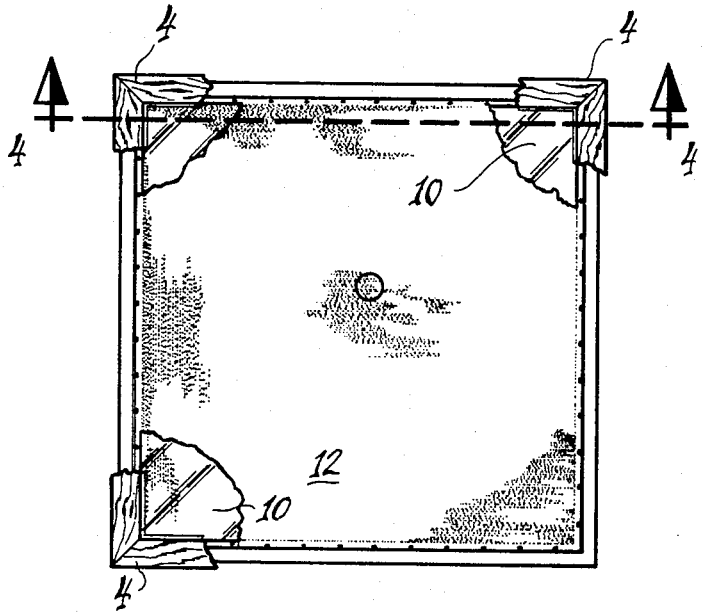
FIG. 2 is a top plan view of the pin screen with portions of the border frame and portions of the transparent top cover broken away for revealing the heads of pins and the perforated sheet through which the shanks of the pins extend.
Figure 3:
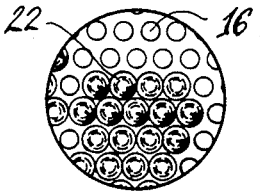
FIG. 3 is an enlarged detail view taken from the circle of FIG. 2 and showing the heads of the pins and the perforated sheet with some of the pins not yet inserted in the respective holes.
Figure 4:
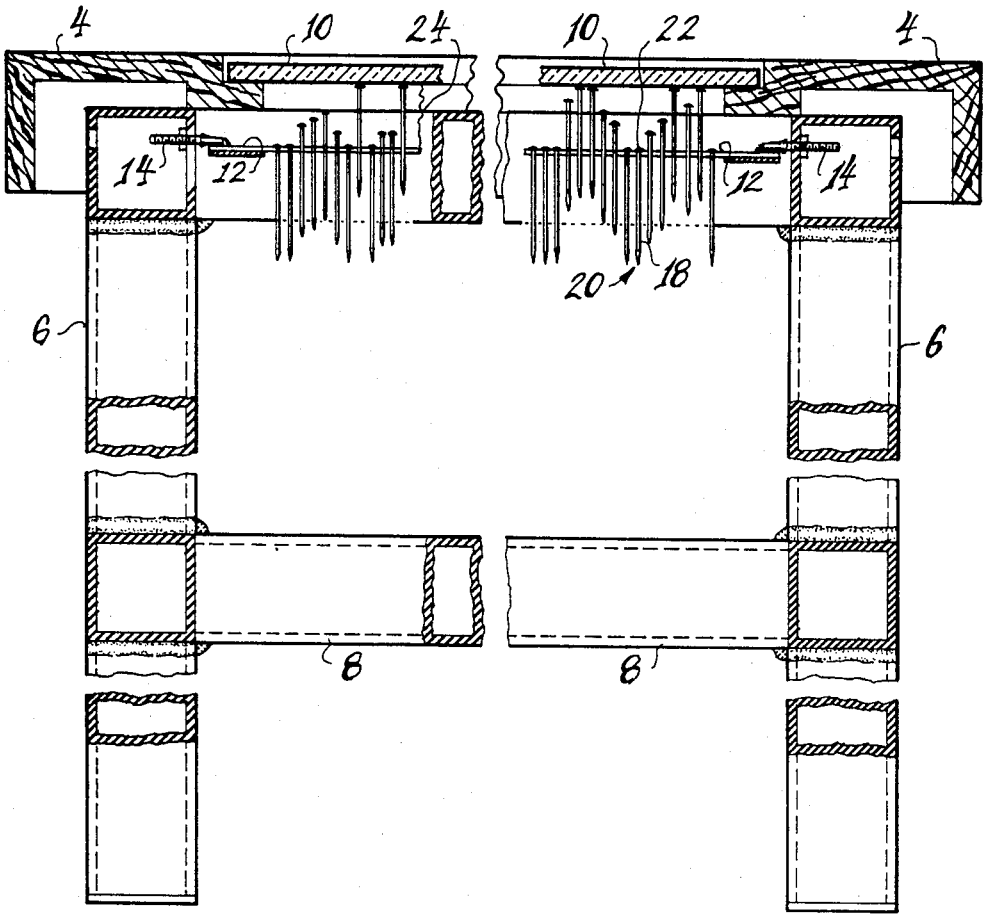
FIG. 4 is an enlarged sectional view of the pin screen taken along the line 4—4 of FIG. 2 and wherein portions have been omitted for convenience of illustration.

Referring now to FIGS. 2–4, an apertured plate 12 is mounted horizontally beneath the transparent cover 10 so that plate 12 and cover 10 are in a spaced parallel relationship to each other. A plurality of clamps 14 are provided to mount the apertured plate to the upper portions of the table legs 6. The plate 12 has a plurality of small closely spaced openings or apertures 16 defined therein, as best illustrated by FIG. 3. Each aperture is adapted to receive the shank 18 of a pin 20 movably received therein, as clearly illustrated by FIG. 4. The heads 22 of the pins 18 are above the top surface of the plate 12. The width of these heads must be greater than the diameter of the apertures 16 to prevent the pins from falling downwardly through the apertures.

As illustrated in FIG. 4, the individual pins 20 are selectively vertically movable with their respective apertures 16. Specifically, the pins may be moved vertically either upwardly or downwardly by applying a force in the appropriate direction to the lower portions of the shanks 18 extending downwardly from the apertured plate 12. Each pin is vertically movable from a first lower position in which the pin head 22 abuts against the upper surface of the plate 12, and an upper position in which the pin head abuts against the lower surface of the transparent cover 10. Moreover, each pin selectively can be moved so that its head 22 is positioned intermediate the upper transparent cover 10 and the lower apertured plate 12.

When a pin is in its lower position with the pin head abutting against the upper surface of the plate 12, the pin is held in place because the head 22 is wider than the respective aperture 16, as discussed above. When the pin head is either in its upper position abutting against the lower surface of the cover 10, or is in an intermediate position between the plate 12 and the cover 10, the pin is held in place by frictional engagement between the pin shank 18 and the periphery of the opening 16 on the plate 12 through which the shank is inserted. The distance 24 between the plate 12 and the cover 10 should be less than the length of the pin shank so that the pin cannot be pushed upwardly to the extent that it will disengage entirely from its respective opening.

It is apparent now that the pin screen described above may be used to create different visual displays and dynamically changing patterns by selectively vertically displacing all or some of the pins, thereby varying the relative orientation and attitude of the pin heads which are viewed by an observer through the upper transparent cover 10. Moreover, reflection of light by the differently oriented pin heads, and any oscillating or vibrating movements of the pins relative to the apertured plate, provide a dynamically varying, fluid-like, pulsating display.

FIGS. 5–9 of the drawings illustrates vertical embodiments of a pin screen in accordance with the present invention.

Figure 5:
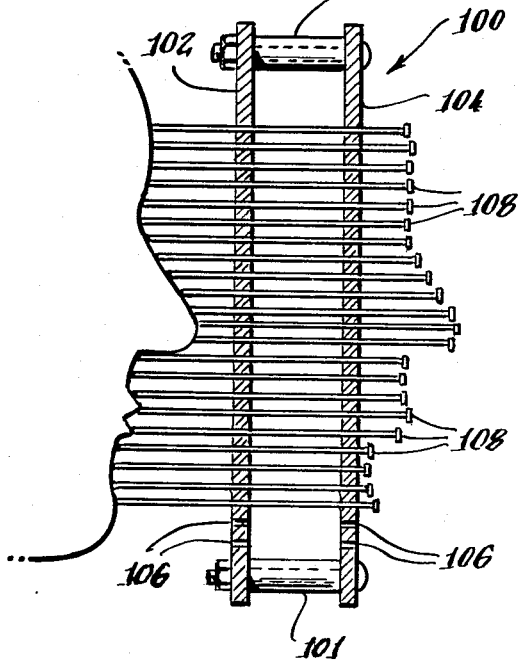
FIG. 5 is a side view, in section, illustrating an embodiment of the invention in which a pin screen has two vertical apertured plates and the pins are displaced horizontally.

In FIG. 5, a vertically oriented housing 100 includes two parallel vertical apertured plates 102 and 104. The two vertical plates have horizontally aligned apertures 106, and the plates are spaced a predetermined distance apart by bolts and spacers generally designated by reference numeral 101. A plurality of pins 108 are received in and inserted through the respective aligned openings or apertures defined on both parallel vertical plates. Each pin is inserted through one opening on the first plate 102 and the same pin extends to and is inserted through the corresponding horizontally aligned opening on the second plate 104. The spacing between the two vertical plates is less than the length of the pins.

As illustrated in FIG. 5, the pins are inserted through the parallel plates such that the respective pin heads are closest to apertured plate 104, while the ends of the pins are closest to the apertured plate 102. The user of the pin screen may selectively displace the pins by pressing against the pin ends extending through the left side of plate 102 to horizontally displace pins and pin heads towards the right in FIG. 5. For example, the user may force his face against the pin ends on the left side of plate 102, resulting in pins corresponding to the three-dimensional configuration of the face being displaced horizontally towards the right. The horizontally displaced pin heads, when viewed from the right side of plate 104, recreate a three-dimensional configuration of the object displacing the pins, which in the above example, is the user's face. The pins are held in their respective apertures in plate 102 and 104 by frictional engagement between the bodies or shanks of the pins and the apertured plates. The spacing between the two vertical plates is sufficiently great to assure that the horizontally displaced pins will not pivot relative to the two apertured plates, but will remain horizontally oriented.

Preferably, the pins will be about 3 inches in length and the plates will be separated by a distance less than the length of the pins. Preferably, the plates will be separated by about ½ inch but not more than about 2½ inches to allow at least a ½ inch range of horizontal displacement of the pins. The plates may be formed from 22 gauge steel or from phenolic or other rigid plastics. The pin shanks may be about 1/16 inch in diameter and the apertures in the plates will be slightly larger than the diameter of the shanks. The pin heads are sufficiently large to prevent the heads from passing through the apertures, preferably about ⅛ inch. The ends of the pins will be flat or rounded and not pointed to prevent injury or damage to the objects pressed against them. In the preferred embodiment of the vertical pin screen, the spacing of the apertures 106 on each apertured plate is about 7/64 inch center to center. The apertures in the plates can be defined in a staggered row pattern with alternate rows aligned.

Figure 7:
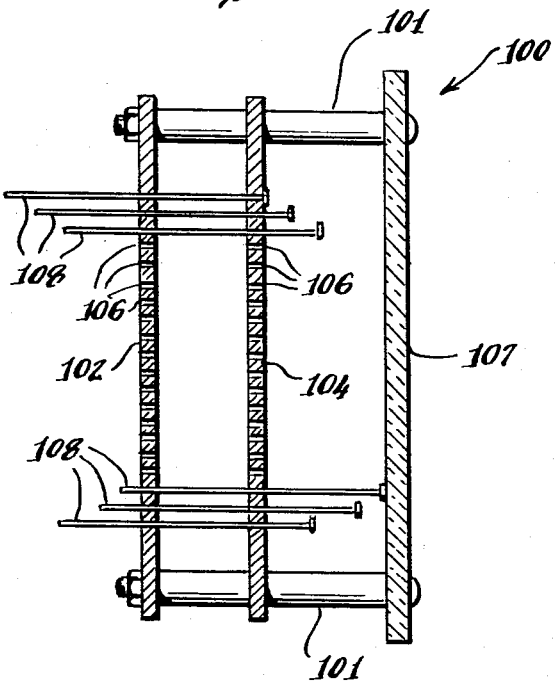
FIG. 7 illustrates the embodiment shown in FIG. 5 in which a transparent sheet has been added to limit the degree of horizontal displacement of the pins.

FIG. 7 is similar to the embodiment of FIG. 5 except that the pin screen housing 100 now includes a vertical transparent cover 107 parallel to the plates 102 and 104 and spaced to the righ of plate 104. The distance between the transparent cover and the leftmost apertured plate 102 must be less than the length of the pins, preferably about ½ inch less. In the embodiment of FIG. 7, the heads of horizontally displaced pins abut against the transparent cover, thus preventing a user from pushing the pins completely out of the apertured plates. The transparent cover may be a thin glass or plastic sheet and can be supported in a vertical position by extended bolts and spacer elements extending from apertured plate 104.

In both the FIGS. 5 and 7 embodiments of the invention, the displaced pins are returned to the initial position (in which the pin heads abut against the right side of apertured plate 104) by gravitational forces by lifting the housing 100 and tilting it to the left. Also, in the FIG. 5 embodiment, the displaced pins may be returned to the initial position by physically pushing the pin heads to the left from a position to the right of apertured plate 104.

Figure 6:
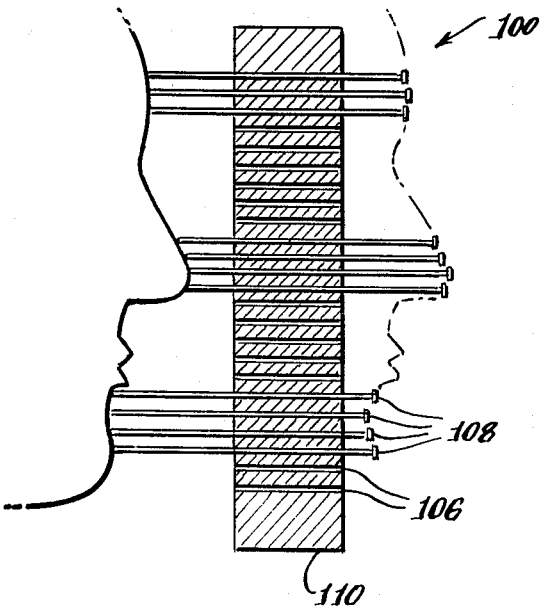
FIG. 6 is a side view, in section, similar to the vertical pin screen of FIG. 5 except this embodiment includes only a single vertically oriented apertured plate.
Figure 8:
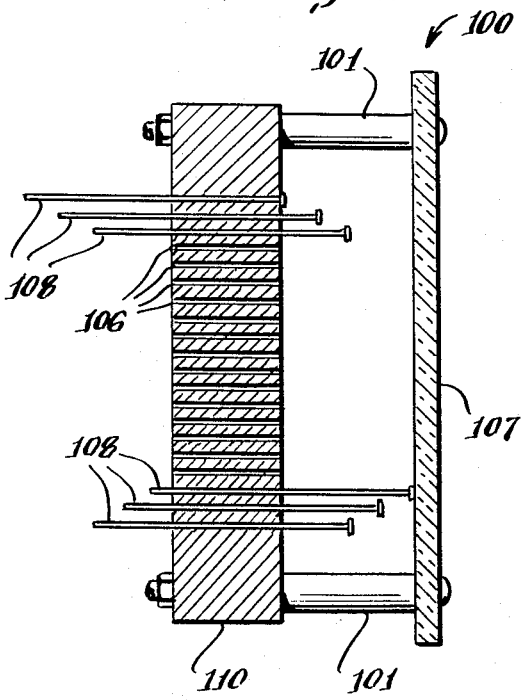
FIG. 8 illustrates the embodiment shown in FIG. 6 in which a transparent sheet has been added to limit the degree of horizontal displacement of the pins.

The embodiments of FIGS. 6 and 8 are substantially identical to the embodiments of FIGS. 5 and 7 respectively, with one exception. Instead of the two relatively thin parallel apertured vertical plates 102 and 104 of the FIGS. 5 and 7 embodiments, the FIGS. 6 and 8 embodiments include a single thick apertured vertical plate 110. The thickness of the single plate 110 must be less than the length of the pins, and is approximately equal to the separation distance of plates 102 and 104 of FIGS. 5 and 7. The pins are held in the single plate 110 by frictional engagement therewith, and the plate is sufficiently thick (e.g., ½") relative to the length of the pin shanks (e.g., 3") to prevent pivoting of the pins and to maintain the horizontal orientation of the pins. The operation and structure of the FIGS. 6 and 8 vertical pin screen embodiments, except as noted herein, are identical to that of FIGS. 5 and 7. Accordingly, corresponding reference numerals have been used for corresponding structure.

Figure 9:
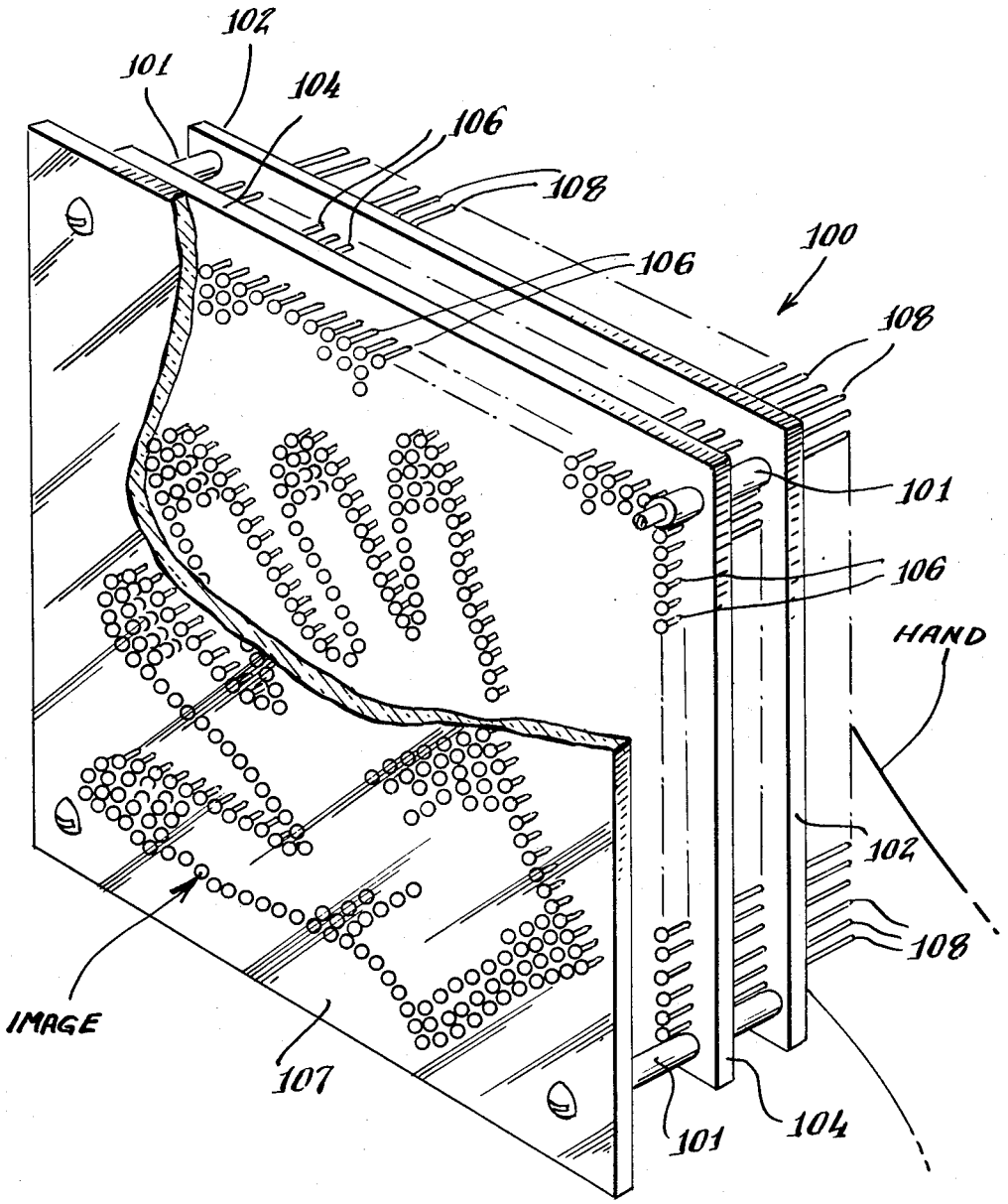
FIG. 9 is a perspective view of the pin screen illustrated by FIGS. 5–8 showing a three-dimensional image resulting from the selective horizontal displacement of the pins.

FIG. 9 is a perspective view of any of the embodiments of the vertical pin screens of FIGS. 5–8. FIG. 9 shows the three-dimensional configuration as viewed from the right side of any of the embodiments of FIGS. 5–8. The three-dimensional image of a hand is formed by the horizontal displacement of pin heads resulting from the impression of the image to be reproduced against the ends of the pins extending from the left side of the pin screens illustrated in FIGS. 5–8.

I claim:

1. A pin screen for producing visual display comprising:

a plate having a plurality of apertures extending through said plate, supporting means supporting said plate in an elevated position relative to the ground, at least some of said apertures in said plate receiving pins having (1) a shank insertable through said aperture and being selectively relatively movable with respect to said plate and (2) a pin head larger in width than the diameter of said aperture, said pins inserted through said apertures being selectively movable relative to said plate through said respective apertures, said pins producing a visual display resultant only from the varying attitudes of said pin heads and oscillating and vibrating movements of the pin heads relative to said apertured plate.

2. The pin screen as claimed in claim 1 wherein said supporting means is adapted to support said plate in a substantially horizontal position.

3. The pin screen as claimed in claim 1 wherein said pins are adapted to be moved in said respective apertures in a direction substantially perpendicular to said plate.

4. The pin screen as claimed in claim 1 further including a transparent cover mounted to said supporting means above said plate, said transparent cover and said plate being in substantially parallel relationship relative to each other.

5. The pin screen as claimed in claim 4 wherein said transparent cover is formed from glass.

6. The pin screen as claimed in claim 4 wherein said transparent cover is horizontally mounted within said supporting means.

7. The pin screen as claimed in claim 4 wherein the distance between said transparent cover and said plate is not greater than the length of the shanks of said pins adapted to be inserted through said plurality of apertures.

8. The pin screen as claimed in claim 4 wherein said supporting means includes an upper frame.

9. The pin screen as claimed in claim 8 wherein said transparent cover is removably mounted in said frame.

10. The pin screen as claimed in claim 1 wherein said plate is removably mounted to said supporting means by clamps extending from said supporting means.

* * * * *